US008876438B2

(12) United States Patent
Bergmann

(10) Patent No.: US 8,876,438 B2
(45) Date of Patent: Nov. 4, 2014

(54) PROCESS FOR CASTING CONCRETE WALL BLOCKS FOR USE WITH GEOGRID

(75) Inventor: John W. Bergmann, East Jordan, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 550 days.

(21) Appl. No.: 12/847,348

(22) Filed: Jul. 30, 2010

(65) Prior Publication Data

US 2012/0023857 A1 Feb. 2, 2012

(51) Int. Cl.

| | |
|---|---|
| ***E02D 29/00*** | (2006.01) |
| ***E04C 1/39*** | (2006.01) |
| ***B28B 7/18*** | (2006.01) |
| ***E02D 29/02*** | (2006.01) |
| *E04B 2/02* | (2006.01) |

(52) U.S. Cl.

CPC ..... *B28B 7/183* (2013.01); *E04C 1/395* (2013.01); *E04B 2002/0267* (2013.01); *E02D 29/0241* (2013.01); *E04B 2002/0215* (2013.01); *E02D 29/025* (2013.01)

USPC ..... 405/284; 264/328.9

(58) Field of Classification Search

USPC ..... 405/284; D25/113–118; 264/318, 264/328.9; 52/600, 604, 605, 609, 607

See application file for complete search history.

(56) References Cited

U.S. PATENT DOCUMENTS

| | | | | | |
|---|---|---|---|---|---|
| 887,814 | A * | 5/1908 | Johnson | 249/172 |
| 1,752,671 | A * | 4/1930 | Knight | 52/601 |
| 2,283,968 | A * | 5/1942 | Bunch | 249/165 |
| 3,380,121 | A * | 4/1968 | Chittenden et al. | 425/528 |
| 3,601,355 | A * | 8/1971 | Fleck | 249/91 |
| 4,780,999 | A * | 11/1988 | Webb et al. | 52/96 |
| 4,790,508 | A * | 12/1988 | Henderson et al. | 249/11 |
| 5,163,261 | A * | 11/1992 | O'Neill | 405/284 |
| 5,624,211 | A * | 4/1997 | Anderson et al. | 405/286 |
| 5,788,423 | A * | 8/1998 | Perkins | 405/284 |
| 5,823,709 | A * | 10/1998 | Maher et al. | 405/20 |
| 5,839,855 | A * | 11/1998 | Anderson et al. | 405/262 |
| 5,851,088 | A * | 12/1998 | Anderson et al. | 405/284 |
| 5,911,539 | A * | 6/1999 | Egan et al. | 405/20 |
| 6,338,597 | B1 * | 1/2002 | Rainey | 405/262 |
| 6,416,260 | B1 * | 7/2002 | Khamis | 405/286 |
| 6,565,289 | B2 | 5/2003 | Khamis | |
| 6,829,867 | B2 * | 12/2004 | Gresser et al. | 52/603 |
| 6,835,343 | B2 * | 12/2004 | Manthei et al. | 264/271.1 |
| 6,854,702 | B2 * | 2/2005 | Manthei et al. | 249/171 |
| 7,048,469 | B1 * | 5/2006 | Jansson | 405/20 |
| RE39,922 | E * | 11/2007 | Rainey | 405/262 |
| D615,668 | S * | 5/2010 | Hammer | D25/113 |

(Continued)

*Primary Examiner* — Doug Hutton, Jr.
*Assistant Examiner* — Patrick Lambe
(74) *Attorney, Agent, or Firm* — MacMillan, Sobanski & Todd, LLC

(57) ABSTRACT

In casting concrete retaining wall blocks, a plurality of mold inserts form a passage between top and bottom surfaces of the block, a recess in the block top between the passage and the back of the block and a recess in the bottom of the block between the passage and the back of the block. The recesses and the passage are formed by a plurality of mold inserts. When the blocks are used in a retaining wall, geogrid fabric passes from the rear of the wall through one of the recesses in a block, through the passage in the block and through the other recess in the block into backfill for stabilizing the wall. The recesses and passage are designed so that any concrete flashing formed between abutting mold inserts is not contacted by the geogrid fabric.

6 Claims, 2 Drawing Sheets

(56) References Cited

U.S. PATENT DOCUMENTS

| | | | | |
|---|---|---|---|---|
| 7,828,498 | B2 | 11/2010 | Sorheim et al. | |
| D639,456 | S * | 6/2011 | Mugge et al. | D25/113 |
| D650,918 | S * | 12/2011 | Hammer | D25/113 |
| 8,132,988 | B2 * | 3/2012 | Dawson et al. | 405/286 |
| D663,858 | S * | 7/2012 | MacDonald | D25/113 |
| D666,740 | S * | 9/2012 | MacDonald et al. | D25/113 |
| D667,566 | S * | 9/2012 | MacDonald et al. | D25/113 |
| 2001/0026734 | A1 * | 10/2001 | Manthei | 405/284 |
| 2002/0119015 | A1 * | 8/2002 | Khamis | 405/284 |
| 2003/0127581 | A1 * | 7/2003 | Manthei et al. | 249/171 |
| 2003/0140585 | A1 * | 7/2003 | Dueck et al. | 52/293.2 |
| 2003/0214069 | A1 * | 11/2003 | Suto et al. | 264/162 |
| 2004/0028484 | A1 * | 2/2004 | Woolford | 405/286 |
| 2004/0179903 | A1 * | 9/2004 | Rainey et al. | 405/284 |
| 2004/0227053 | A1 * | 11/2004 | Manthei | 249/83 |
| 2005/0016106 | A1 * | 1/2005 | Dawson et al. | 52/562 |
| 2005/0069389 | A1 * | 3/2005 | Shaw | 405/286 |
| 2005/0265792 | A1 * | 12/2005 | Lee | 405/286 |
| 2006/0171784 | A1 * | 8/2006 | Shaw | 405/286 |
| 2007/0003381 | A1 * | 1/2007 | Lee | 405/286 |
| 2007/0196184 | A1 * | 8/2007 | Hammer et al. | 405/284 |
| 2008/0118309 | A1 * | 5/2008 | Jansson | 405/20 |
| 2008/0134603 | A1 * | 6/2008 | Henderson | 52/293.2 |
| 2008/0260474 | A1 * | 10/2008 | Koster | 405/284 |
| 2008/0292413 | A1 * | 11/2008 | Mateer | 405/284 |
| 2009/0094917 | A1 * | 4/2009 | McIntosh | 52/311.1 |
| 2009/0142145 | A1 * | 6/2009 | Martin | 405/303 |
| 2009/0313936 | A1 * | 12/2009 | MacDonald et al. | 52/598 |
| 2010/0215442 | A1 * | 8/2010 | Ackerstein | 405/284 |
| 2010/0251649 | A1 * | 10/2010 | Woolbright | 52/309.17 |
| 2010/0310324 | A1 * | 12/2010 | Bott | 405/284 |
| 2011/0318100 | A1 * | 12/2011 | Rainey | 404/6 |

* cited by examiner

PROCESS FOR CASTING CONCRETE WALL BLOCKS FOR USE WITH GEOGRID

CROSS-REFERENCE TO RELATED APPLICATIONS

Not applicable.

STATEMENT REGARDING FEDERALLY SPONSOREDRESEARCH OR DEVELOPMENT

Not applicable.

TECHNICAL FIELD

The invention relates to a process casting concrete wall blocks having a central passage for securing a geogrid fabric to the wall block, and to wall blocks cast according to the process.

BACKGROUND OF THE INVENTION

Geogrid systems are commonly used for stabilizing retain walls. In one such system, a retaining wall is formed from stacked large concrete blocks. Passages or openings are formed to extend vertically through each block. In constructing a retaining wall, a first tier of blocks is set in place. Geogrid webs are positioned to stabilize the blocks in this tier. Each web extends from behind the blocks and upwardly through a vertical opening in a block. Backfill is then placed over the web and compacted, and the web is then positioned to extend from the top of the block over the compacted backfill. After each block in the tier is secured with one or more webs and backfill is added behind the tier, a second tier of blocks may be stacked on the first tier of blocks. The blocks are then secured with geogrid webs and backfill is added behind the second tier of blocks. This process is continued until the retaining wall extends to a desired height and width. This retaining wall system is shown, for example, in U.S. Pat. No. 6,565,289 wherein two geogrid webs anchor each wall block.

BRIEF SUMMARY OF THE INVENTION

The invention is directed to a method of casting concrete retaining wall blocks and to the cast blocks for use with a geogrid system which stabilizes a wall constructed with the blocks. Mold inserts are used to form a passage between top and bottom surfaces of the block, a recess in the block top between the top of the passage and the rear of the block and a recess in the bottom of the block between the bottom of the passage and the rear of the block. When constructing a retaining wall with the blocks, a web of geogrid fabric is passed from the rear of the block through one of the recesses, through the passage and back through the other recess to the rear of the block. The geogrid fabric is anchored in backfill behind the retaining wall. According to the invention, the recesses and the passage are formed by a plurality of mold inserts to provide smooth contact surfaces for the geogrid fabric. The recesses and passage are designed so that corners are rounded and so that any concrete flashing formed between abutting mold inserts is not contacted by the geogrid fabric.

Various objects and advantages of the invention will become apparent from the following detailed description of the invention and the accompanying drawings.

DETAILED DESCRIPTION OF THE INVENTION

Figure 1:
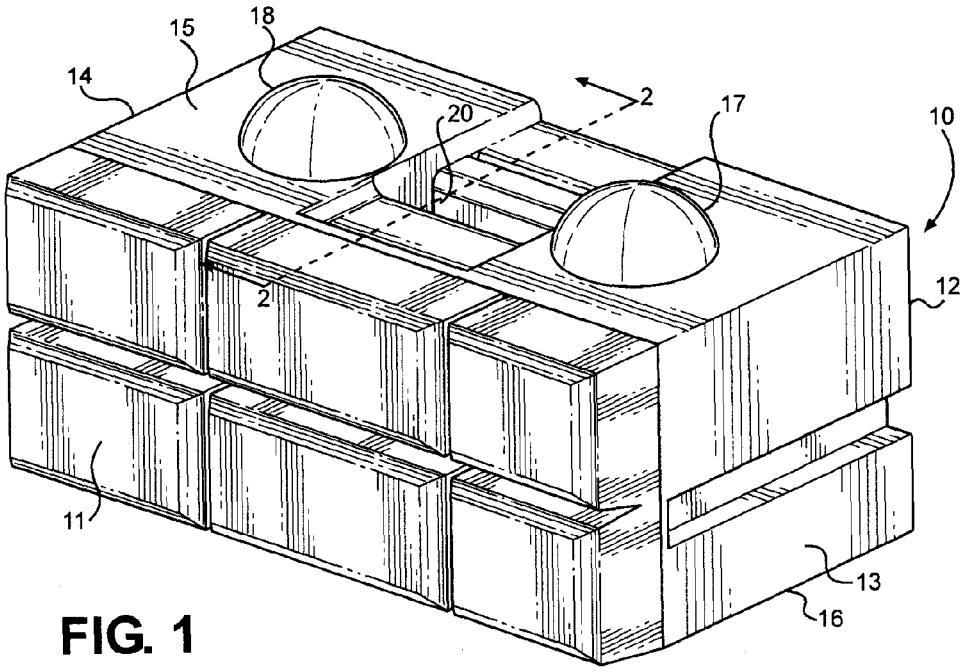
FIG. 1 is a perspective view of an exemplary retaining wall block formed according to the invention with a passage between the top and bottom of the block and recesses for use in securing a geogrid web.
Figure 2:
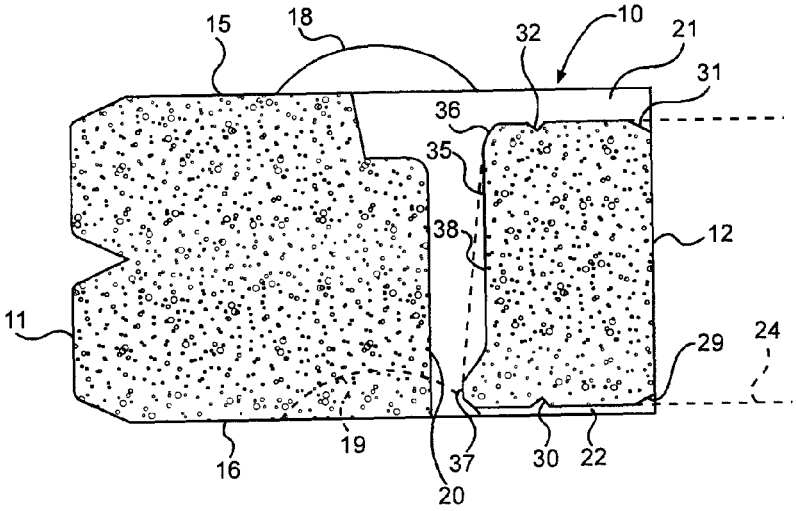
FIG. 2 is a cross sectional view of the exemplary wall block taken along line 2-2 of FIG. 1.

An exemplary concrete wall block 10 is illustrated in FIGS. 1 and 2. The exemplary block 10 has a face 11 which is exposed when a number of blocks 10 are arranged to form a retaining wall. The illustrated face 11 is shaped to simulate 6 smaller blocks. However, it will be appreciated that the face 11 may have any desired shape and texture, such as simulating one or more blocks, or one or more weathered stones, or simply a decorative texture. The block 10 has a back 12, two sides 13 and 14, a top 15 and a bottom 16. The back 12 and the sides 13 and 14 are generally vertical. Preferably, the back 12 is shorter in width than the face 11 so that the sides 13 and 14 angle slightly towards the back. This facilitates positioning the faces 11 of two adjacent blocks to abut with the faces forming an angle relative to each other for curving or bending the retaining wall, as is known in the art.

In the illustrated embodiment of the block 10, two knobs 17 and 18 project from the block top 15. The knobs 17 and 18 are spaced apart and are equally spaced from the block face 11. Two complimentary recesses 19 are formed in the block bottom 16. When a number of blocks 10 are stacked, the recesses 19 on an upper block in the stack receive the knobs 17 and 18 from two adjacent lower blocks for securing the blocks together and preventing movement of the blocks. In an alternate embodiment, the recesses 19 may be replaced with a groove extending the width of the block bottom 16 which is shaped to receive the knobs from adjacent lower blocks in the stack. The groove facilitates angling adjacent blocks in each tier for forming a bend or a curve in a retaining wall.

A passage 20 extends a generally vertical direction through the center of the block 10 between the knobs 17 and 18. A recess 21 is formed in the block top 15 to connect the passage 20 to the block back 12, and a recess 22 is formed in the block bottom 16 to connect the passage 20 to the block back 12. The recess 21, the passage 20 and the recess 22 sized to receive a geogrid strap or web for securing the block 10 to backfill behind a retaining wall which includes the block 10.

In FIG. 2, a portion of a geogrid web 24 is shown in dashed lines. The web 24 may have a width of a few inches to 12 inches or more, depending on the size of the block 10, the nature of the backfill in which the web is anchored and the amount of anchoring strength required. The geogrid web or fabric may be formed from any material commonly used for geogrid systems. The geogrid web 24 passes from backfill (not shown) behind the lower rear of the block back 12 through the lower recess 22, upwardly through the vertical passage 20 and then back through the recess 21 and into the backfill (not shown) behind the upper rear of the block back 12. The block 10 may be cast in forms of known design. For example, the block may be cast in a form similar to the form disclosed in U.S. Pat. No. 6,557,818 to Manthei, the disclosure of which is incorporated herein. The form is modified with the addition of mold inserts, as described below. Optionally, side grooves may be formed in the blocks for handling the blocks with a forklift, as shown and described in U.S. Pat. No. 6,835,343 to Manthei et al.

In manufacturing the block 10, the recesses 21 and 22 and the passage 20 are formed by inserts which are positioned in the form in which the block 10 is cast. The inserts are withdrawn from the block after the concrete has cured. In order to form the desired shapes of the recesses 21 and 22 and the passage 20, a plurality of inserts are used. When the concrete block is cast, a limited amount of cement may flow into seams between the abutting mold inserts. When this cement hardens, it can form rough flashing in the recesses and the passage. If the geogrid fabric comes into contact with the flashing, it can cut or weaken the geogrid, and possibly adversely affect the stability of the retaining wall. According to the invention, the recesses 21 and 22 and the passage 20 are designed so that the geogrid web contacts only smooth surfaces and cannot come into contact with sharp corner or with any flashing produced during the block casting process.

Figure 3:
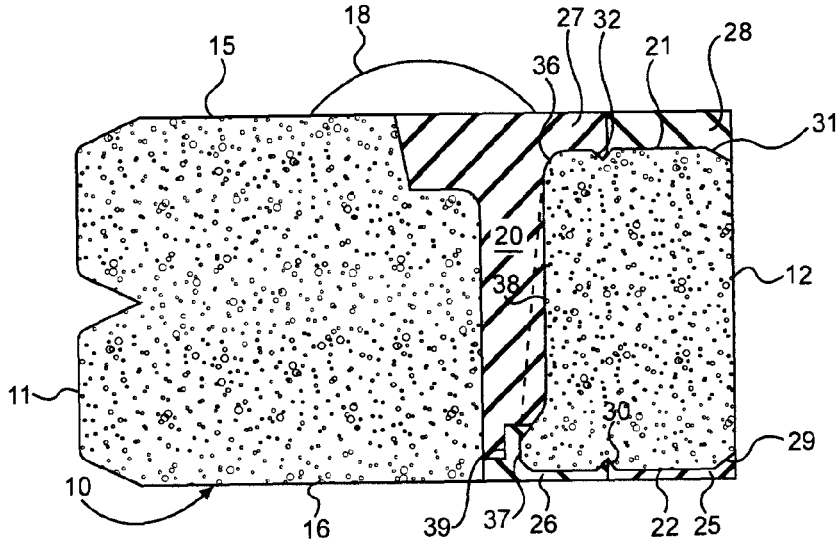
FIG. 3 is a cross sectional view similar to FIG. 3, but showing the inserts used for defining the vertical geogrid opening in the block.
Figure 4:
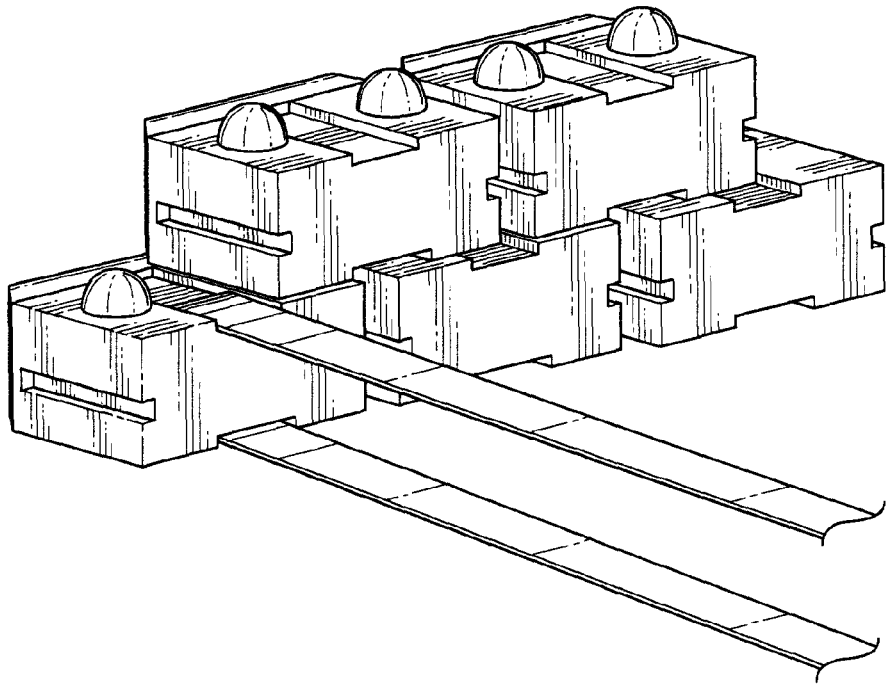
FIG. 4 is a perspective view of a portion of a retaining wall constructed with a plurality of the FIG. 1 blocks showing attachment of a geogrid web to one of the wall blocks.

FIGS. 2 and 3 illustrate the process for forming the recesses 21 and 22 and the passage 20 for avoiding contact between the geogrid fabric and any flashing produced when the block 10 is cast. For the illustrated embodiment, four resilient mold inserts 25-28 are used to form the recesses 21 and 22 and the passage 20. It will be appreciated that a greater or a lesser number of inserts may be required, depending on the design of the recesses and the passage. The insert 25 forms a rearward portion of the lower recess 22 adjacent the block back 12. Preferably, the insert 25 forms a slight angle 29 in the recess 22 adjacent the block back 12 so that the geogrid fabric when pulled taut will not contact any flashing between the recess 22 and the back 12. Alternately, the angle 29 may be replaced with a rounded surface (not shown). A groove 30 extends across the width of the recess 22 where the inserts 25 and 26 abut while the block 10 is cast. Any flashing formed by the seam between the inserts 25 and 26 will remain in the groove 30 where it cannot be contacted by the taut geogrid fabric. The recess 21 is formed in a similar manner by the mold inserts 27 and 28. The insert 28 may form a slight angle 31 in the recess 21 adjacent the block back 12 so that any flashing in the recess 21 adjacent the block back 12 is spaced away from the geogrid fabric which extends from the recess 21 to the rear of the block 10. Alternately, the angle 31 may be replaced with a rounded surface (not shown). A groove 32 extends across the width of the recess 21 where the inserts 27 and 28 abut while the block 10 is cast. Any flashing formed in the seam between the inserts 27 and 28 will remain in the groove 32 where it cannot be contacted by the taut geogrid fabric.

The passage 20 and the recesses 21 and 21 have a width greater than the width of the geogrid web. When looking in the direction of the cross section shown in FIGS. 2 and 3, the passage 20 may be vertical or may be angled between the top and bottom of the block 20, as shown. A key feature of the passage 20 is that a back wall 35 extending between a rounded upper edge 36 where it joins the upper recess 21 and a rounded lower edge 37 where it joins the lower recess 22 has a mid section 38 which is spaced behind a straight line connecting the upper edge 26 and the lower edge 37. Consequently, the geogrid web 24 when passed from the rear of the block 10 through the recess 21, downwardly through the passage 20 and back through the recess 22 to the rear of the block and when stretched taut will not contact the mid section 38 of the rear wall 35. When casting the block 10, the mold inserts 26 and 27 are designed so that they abut in the region of the mid section 38 so that the taught geogrid fabric cannot contact any flashing formed between the mold inserts 26 and 27. As shown in FIG. 3, the mold inserts 26 and 27 abut at a joint 39 located just above and to the rear of the rounded lower edge 37. Preferably, the joint 39 is designed to align the inserts to align the inserts 26 and 27 in the block form while the block 10 is cast. Various known joint constructions may be used, such as a tongue and groove, or a V groove on one of the inserts and a complimentary V ridge on the other insert. It should be appreciated that at least the longer portion of the insert 27 which forms the passage 20 may have a taper to facilitate removal from the cast block 10. If also should be appreciated that the rounded upper edge 36 and the rounded lower edge 27 need not be vertically aligned.

Various modifications and changes may be made to the above described process and block without departing from the scope of the following claims.

The invention claimed is:

1. A method for casting a concrete retaining wall block for use with a geogrid fabric, said retaining wall block having a passage for the geogrid fabric extending between a top of the block and a bottom of the block, a top recess for passing the geogrid fabric between a back of the block and the passage and a bottom recess for passing the geogrid fabric between the passage and the back of the block, said method comprising the steps of:

a) providing a form in which the block is cast;

b) positioning in said form a plurality of shaped mold inserts for forming said recesses and said passage, at least two of said mold inserts for forming the passage abutting while a block is cast, wherein flashing may be formed on a rear side of the passage between such abutting mold inserts, and wherein said mold inserts are shaped to form a raised portion in said passage whereby any flashing formed on the rear side of the passage is spaced away from the geogrid fabric when a cast block installed in a retaining wall is secured with the geogrid fabric extending through the top recess, the passage over the raised portion and the bottom recess;

c) casting a block in the form; and d) separating the cast block from the form and the mold inserts.

2. A method for casting a concrete retaining block, as set forth in claim 1, and wherein said mold inserts are shaped for forming an upper rounded corner between the top recess in the block and the passage and for forming a lower rounded corner between the passage and the bottom recess.

3. A cast concrete retaining wall block including a front, a back, a top, and a bottom, said block having a passage extending between the block top and the block bottom, an upper recess in said block top connecting between said passage and said block back, a lower recess in said block bottom extending between said passage and said block back, said recesses and said passage being shaped for passing a geogrid fabric from behind said block back through one of the recesses, through the passage and through the other of said recesses to said block back, said block having an upper rounded corner between said upper recess and said passage and having a lower rounded corner between said passage and said lower recess, wherein said passage has a back wall between said upper rounded corner and said lower rounded corner with at least a portion of the back wall spaced to the rear of a line between said upper rounded corner and said lower rounded corner, and wherein any flashing formed on the back wall is located on said portion of the back wall wherein any such flashing will not be in contact with a geogrid fabric passed through the said passage during use of said block.

4. A cast concrete retaining wall block, as set forth in claim 3, and wherein the majority of the back wall of the passage is spaced to the rear of a line between said upper rounded corner and said lower rounded corner.

5. A cast concrete retaining wall block, as set forth in claim 3, and wherein said upper recess is formed by at least two abutting upper mold inserts, and wherein said upper recess has an upper groove formed where two upper mold inserts abutted when said block was cast whereby any flashing formed on said block where the two upper inserts abutted is located in said groove.

6. A cast concrete retaining wall block, as set forth in claim 5, and wherein said lower recess is formed by at least two abutting lower mold inserts, and wherein said lower recess has a lower groove formed where two lower mold inserts abutted when said block was cast whereby any flashing formed on said block where the two lower inserts abutted is located in said groove.

* * * * *